US008902119B2

(12) United States Patent
Menke et al.

(10) Patent No.: US 8,902,119 B2
(45) Date of Patent: Dec. 2, 2014

(54) DUAL POLARIZED UHF ANTENNA

(75) Inventors: Norbert Wilhelm Menke, Sprockhoevel (DE); Stefan Mieslinger, Essenbach (DE); Michael Kober, Bruckmuehl (DE)

(73) Assignee: Tagstar Systems GmbH, Sauerlach (DE)

( * ) Notice: Subject to any disclaimer, the term of this patent is extended or adjusted under 35 U.S.C. 154(b) by 938 days.

(21) Appl. No.: 12/500,363

(22) Filed: Jul. 9, 2009

(65) Prior Publication Data

US 2011/0006959 A1 Jan. 13, 2011

(51) Int. Cl.

| | |
|---|---|
| ***H01Q 7/00*** | (2006.01) |
| ***H01Q 21/00*** | (2006.01) |
| ***H01Q 1/22*** | (2006.01) |
| ***H01Q 1/38*** | (2006.01) |

(52) U.S. Cl.

CPC ..... *H01Q 1/2225* (2013.01); *H01Q 1/38* (2013.01); *H01Q 7/00* (2013.01)

USPC ..... 343/866; 343/728

(58) Field of Classification Search

USPC ..... 343/866

See application file for complete search history.

(56) References Cited

U.S. PATENT DOCUMENTS

| | | | | |
|---|---|---|---|---|
| 6,190,942 | B1 * | 2/2001 | Wilm et al. | 438/107 |
| 7,323,977 | B2 * | 1/2008 | Kodukula et al. | 340/505 |
| 7,353,598 | B2 * | 4/2008 | Craig et al. | 29/846 |
| 2003/0160723 | A1 * | 8/2003 | Cohen | 343/700 MS |
| 2004/0046663 | A1 * | 3/2004 | Jesser | 340/572.1 |
| 2007/0051807 | A1 * | 3/2007 | Yamaguchi | 235/451 |
| 2007/0052613 | A1 | 3/2007 | Gallschuetz et al. | 343/860 |
| 2009/0033467 | A1 | 2/2009 | Finocchiaro et al. | 340/10.1 |
| 2009/0109002 | A1 | 4/2009 | Hadley et al. | 340/10.1 |

FOREIGN PATENT DOCUMENTS

| | | |
|---|---|---|
| FR | 2915822 | 11/2008 |
| WO | 96/35190 | 11/1996 |
| WO | 98/15916 | 4/1998 |

OTHER PUBLICATIONS

"Antenna Frequency Scaling," The ARRL Antenna Book, 1988, pp. 2-24 to 2-25.*

"The Passive Circuit Elements in the Frequency Domain," Nilsson et al., Electric Circuits, 6th Edition, Prentice Hall, New Jersey, 2001.*

International Search Report for International Application No. PCT/IB2010/002193 mailed Dec. 23, 2010 (5 pgs.).

Lee, Y., "AN710: Antenna Circuit Design for RFID Applications," Microchip Technology, Inc, 2003, pp. 1-50.

* cited by examiner

*Primary Examiner* — Graham Smith

(74) *Attorney, Agent, or Firm* — Proskauer Rose LLP

(57) ABSTRACT

Described are antenna assemblies and methods for forming antenna assemblies. An antenna assembly includes a dual polarized far-field antenna and a near-field loop antenna. The near-field loop antenna is electromagnetically coupled to the dual polarized far-field antenna. The near-field loop antenna includes two contacts for electrically connecting to a chip.

26 Claims, 5 Drawing Sheets

DUAL POLARIZED UHF ANTENNA

FIELD OF THE INVENTION

The invention relates generally to RFID antenna assemblies and methods for forming RFID antenna assemblies.

BACKGROUND OF THE INVENTION

Radio-Frequency Identification (RFID) technology is directed to wireless communication between one object, typically referred to as a RFID tag, and another object, typically referred to as a RFID reader/writer. RFID technology has been adopted, and is increasingly being used, in virtually every industry, including, for example, manufacturing, transportation, retail, and waste management. As such, efficient RFID systems are becoming increasingly important as the demand for RFID technology increases.

RFID tags typically include two components: a RFID antenna assembly and an RFID integrated circuit (IC). RFID antennas can be used to receive and/or transmit an electromagnetic signal from a RFID reader/writer. A RFID IC (sometimes referred to as a RFID chip) can be used to store and/or process information (e.g., modulate/demodulate a radio-frequency (RF) signal).

Typically, RFID systems that operate in the ultra-high frequency (UHF) range utilize a standard dipole antenna configuration for the RFID antenna assembly. The performance of a standard dipole UHF transponder depends on the orientation between the transponder antenna and the reader antenna, because dipole antennas can only emit radio signals in one direction. To achieve two-dimensional readability, two or more dipole antennas can be used in a single antenna assembly. For example, two dipole antennas can be arranged perpendicular to each other to form a "double-dipole" antenna, which takes the shape of a cross. Standard "double-dipole" antennas require RFID chips with at least three electrical contact points: two antenna inputs and one ground contact. In other words, RFID chips require a separate channel for each dipole of the antenna assembly.

SUMMARY OF THE INVENTION

One approach to providing two-dimensional readability is to couple a near-field loop antenna with a dual polarized far-field antenna. In one aspect, there is an antenna assembly for two-dimensional readability. The antenna assembly includes a dual polarized far-field antenna and a near-field loop antenna electromagnetically coupled to the dual polarized far-field antenna. The near-field loop antenna includes two contacts for electrically connecting to a chip.

In another aspect, there is a method for forming an antenna assembly. The method includes forming, on a first side of a first substrate, a dual polarized far-field antenna, and forming, on a second side of a second substrate, a near-field loop antenna on a-second layer. The near-field loop antenna includes two contacts for electrically connecting to a chip. The dual polarized far-field antenna is electromagnetically coupled to the near-field loop antenna.

In other examples, any of the aspects above can include one or more of the following features. The chip can include an RFID device. The dual polarized far-field antenna can be a UHF antenna. The near-field loop antenna can be inductively coupled to the dual polarized far-field antenna. The near-field loop antenna can be ohmically coupled to the dual polarized far-field antenna. The near-field loop antenna can be capacitively coupled to the dual polarized far-field antenna. The near-field loop antenna can be coupled to the dual polarized far-field antenna inductively, ohmically, capacitively, or any combination thereof.

In some embodiments, the dual polarized far-field antenna can include a far-field loop antenna. The far-field loop antenna can include a rectangular geometry, a fractal geometry or a symmetrical geometry. The antenna assembly can further include the chip. The chip can be a one-channel chip. The chip can be a multi-channel chip comprising three or more contact pads. The antenna assembly can further include a first layer, a second layer, and a third layer. The first layer can include metallization of the dual polarized far-field antenna. The second layer can include a carrier material. The third layer can include metallization of the near-field loop antenna.

In other examples, the antenna assembly can further include a first layer and a second layer. The first layer can include a carrier material. The second layer can include metallization of the dual polarized far-field antenna and metallization of the near-field loop antenna. The antenna assembly can further include a first carrier material including the dual polarized far-field antenna, and a second carrier material including the near-field loop antenna.

In yet other embodiments, the method can further include ohmically coupling the dual polarized far-field antenna to the near-field loop antenna. The method can further include forming segments of the dual polarized far-field antenna and the near-field loop antenna, wherein the segments inductively couple the dual polarized far-field antenna to the near-field loop antenna. The method can further include forming segments of the dual polarized far-field antenna and the near-field loop antenna, wherein the segments capacitively couple the dual polarized far-field antenna to the near-field loop antenna.

In yet other examples, the first and second substrates can be different and the method can further include positioning the first and second substrates together using lamination, dispensing, bonding, or any combination thereof. The first and second substrates can be the same and the first and second sides can be the same. The first and second substrates can be the same and the first and second sides can be different. The method can further include attaching the second substrate to a device, wherein forming the dual polarized far-field antenna can include printing the dual polarized far-field antenna over the second substrate attached to the device.

Any of the above implementations can realize one or more of the following advantages. By coupling a near-field loop antenna to a dual polarized far-field antenna, two-dimensional readable RFID tags can be made compatible with single-channel RFID chips. In addition, the RFID tags can remain compatible with multi-channel RFID chips.

The details of one or more examples are set forth in the accompanying drawings and the description below. Further features, aspects, and advantages of the invention will become apparent from the description, the drawings, and the claims. The drawings are not necessarily to scale, emphasis instead generally being placed upon illustrating the principles of the invention.

BRIEF DESCRIPTION OF THE DRAWINGS

The advantages of the invention described above, together with further advantages, will be better understood by referring to the following description taken in conjunction with the accompanying drawings. The drawings are not necessarily to scale, emphasis instead generally being placed upon illustrating the principles of the invention.

DESCRIPTION OF THE INVENTION

Figure 1A:
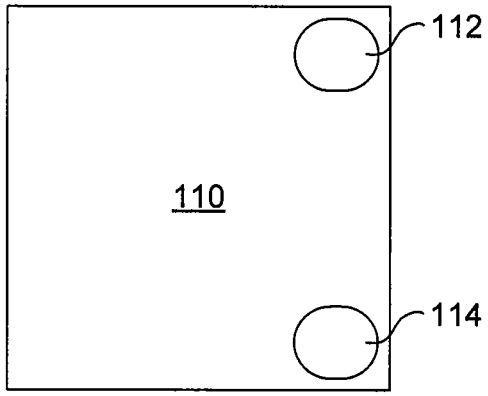
FIGS. 1A-1B are top views of a chip and a near-field loop antenna.

FIG. 1A is a top view of an exemplary chip 110. The chip 110 includes at least two contacts 112 and 114. The contact 112 can be, for example, an antenna port. The contact 114 can be, for example, a ground port. Combined, the contacts 112 and 114 can form a single channel for communicating with a remote reader (not shown) via an antenna assembly. In one embodiment, for example, the chip 110 can include a RFID IC (sometimes referred to as a RFID chip). In a supplemental or alternative embodiment, the chip 110 can process UHF (ultra-high frequency) signals.

The chip 110 illustrated in FIG. 1A includes two contacts positioned in separate corners, but other configurations can also be used. For example, the chip 110 can include additional contacts. In one embodiment, a chip 110 with additional contacts can be used as a multi-channel chip for use with an antenna assembly with two or more channels. For example, a chip with two pairs of contacts that are associated with two chip channels can be connected to an antenna assembly with two separate antenna channels, in which each chip channel transmits and/or receives electromagnetic signals via their respective antenna channel. In yet other configurations, the contacts 112 and 114 can be located at arbitrary positions on the chip 110.

Figure 1B:
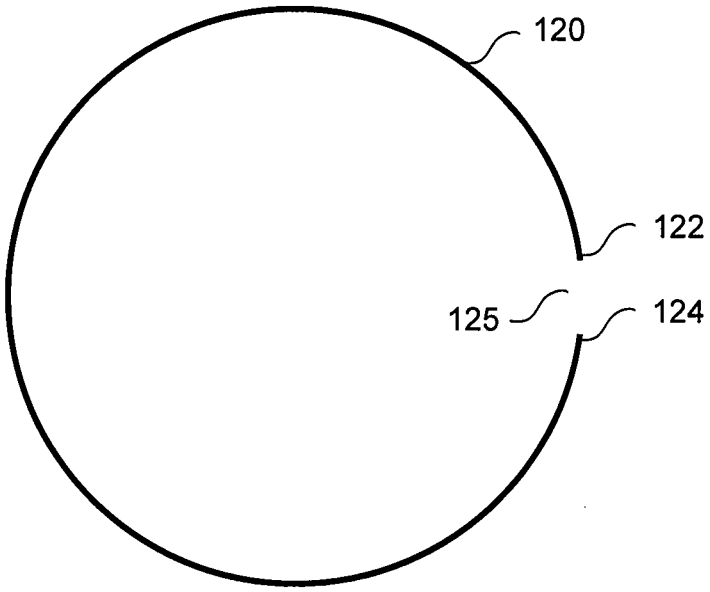

FIG. 1B is a top view of an exemplary near-field loop antenna 120. The near-field loop antenna 120 includes a gap 125 between the contact points 122 and 124. The contact points 122 and 124 can be used to connect to a channel on a chip. For example, the chip 110 can be coupled to the near-field loop antenna 120 by respectively attaching the contact points 122 and 124 to the chip contacts 112 and 114. In one embodiment, the near-field loop antenna 120 can be attached to the chip 110 using flip chip bonding. In another embodiment, the near-field loop antenna 120 can be attached to the chip 110 using wire bonding. In yet another embodiment, the near-field loop antenna 120 can be fabricated on the same substrate as the chip 110.

The near-field loop antenna 120 illustrated in FIG. 1B is configured as a circular loop, but other configurations can also be used. In one embodiment, for example, the near-field loop antenna 120 can be configured as a square loop or as any rotationally symmetric loop. More generally, the near-field loop antenna 120 can be configured in any arbitrary loop path. In some embodiments, the length of the near-field loop antenna 120 can be between 15 mm and 120 mm. The length of the near-field loop antenna 120 can depend on the electrical characteristics of the RFID chip (e.g., impedance, inductivity and/or capacitance).

FIGS. 2A-2F are top views of different antenna assembly configurations 200. The antenna assembly 200*a* includes a dual polarized far-field antenna 210 and a near-field loop antenna 120. A chip 110 can be connected to the near-field loop antenna 120. The dual polarized far-field antenna 210 advantageously can receive and/or transmit electromagnetic waves independent of the polarization of the electric field incident on the plane of the antenna 210. In some embodiments, the length of the dual polarized far-field antenna 210 can be between 240 mm and 400 mm. The length of the far-field antenna 210 can depend on the electrical characteristics of the RFID chip, the quality factor of the coupling to the far-field antenna, and/or the application (e.g., based on the mounting of an RFID tag to any surface resulting in any detuning). Therefore, the resonance frequency of a RFID tag, and consequently the length of the far-field loop 210, can be dependent on the application.

The near-field loop antenna 120 can be positioned into a corner 212 of the dual polarized far-field antenna 210 such that the two antennas are magnetically coupled to each other. For example, the near-field loop antenna 120 can be magnetically coupled to the dual polarized far-field antenna 210 via the magnetic induction that results from the proximity of segments of the two antennas in corner 212. In some configurations, the near-field loop antenna 120 can overlap with the dual polarized far-field antenna 210 or a gap can exist between the two. In a supplemental or alternative embodiment to inductive coupling, the near-field loop antenna 120 can be ohmically and/or capacitively coupled to the dual polarized far-field antenna 210. For example, the antenna assemblies 200*b* and 200*c* include a dual polarized far-field antenna 220 that is ohmically connected to the near-field loop antenna 120 via connections in corners 222*b* and 222*c*. Generally, the far-field antenna 210 can connect to at least one point anywhere on the near-field antenna 120 (e.g., the point that is substantially opposite to the chip's position).

In the antenna assembly configurations 200*a-c*, the dual polarized far-field antennas 210 and 220 are configured as rectangular loops, but other configurations can also be used. In one embodiment, for example, a dual polarized far-field antenna can be configured as any rotationally symmetric loop. More generally, a dual polarized far-field antenna can be configured in any arbitrary loop path. In some embodiments, for example, an antenna assembly configuration 200*d* or 200*e* can include a rectangularly-shaped dual polarized far-field antennas 230*d* or 230*e* with semi-circle indentations 232 located on each side. In an alternative embodiment, an antenna assembly configuration 200*f* can include a dual polarized far-field antenna 240 with a fractal geometry. The near-field loop antenna 120 can be positioned, for example, in the center of the dual polarized far-field antenna 240, which would allow substantially all segments of the near-field loop antenna 120 to be magnetically coupled to segments 242 of the dual polarized far-field antenna 240.

In general, near-field loop antennas and dual polarized far-field antennas can be formed on one or more substrates. Formation of an antenna can include metallization of a side of the substrate. Suitable substrates can include a non-conductive carrier material such as, for example, PET (polyester), FR-4 (or any other printed circuit board (PCB) material), PI (polyimide), BT (bismaleimide-triazine), PE (polyethylene), PVC (polyvinylchloride), PC (polycarbonate), Teslin (silica-filled polyethylene), paper and/or other suitable antenna substrate materials. In addition, substrates can be flexible or rigid. In one embodiment, a near-field loop antenna and a dual polarized far-field antenna can be formed on the same side of a substrate. In an alternative embodiment, a near-field loop antenna and a dual polarized far-field antenna can be formed on different sides of a substrate. In yet another embodiment, a near-field loop antenna and a dual polarized far-field antenna can be formed on different substrates and subsequently brought together using lamination, dispensing, bonding, and/or any other substrate binding process.

In another embodiment, a RFID chip can be bonded to a near-field loop (e.g., an antenna on a carrier material like PET), and the far-field antenna can be printed on the top-side or bottom-side of the carrier material. In yet another embodiment, a RFID chip can be bonded to a near-field loop (e.g., an antenna on a carrier material like PET), and the near-field loop can be laminated, dispensed, bonded, or otherwise attached to any device (e.g., a cardboard box or other housing). A far-field loop antenna can be printed on top of the device to which the near-field loop is attached to.

Figure 3A:
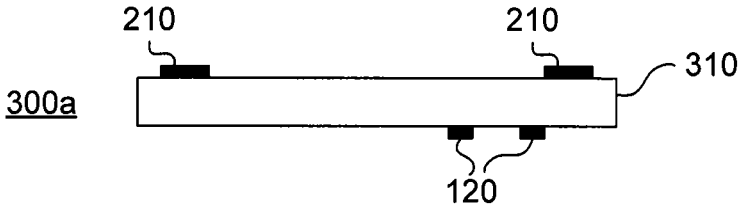
FIGS. 3A-3C are cross-sectional side views of different antenna assembly substrate configurations of FIG. 2A.
Figure 3B:
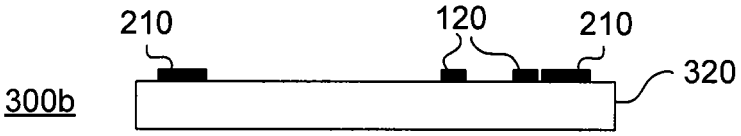
Figure 3C:
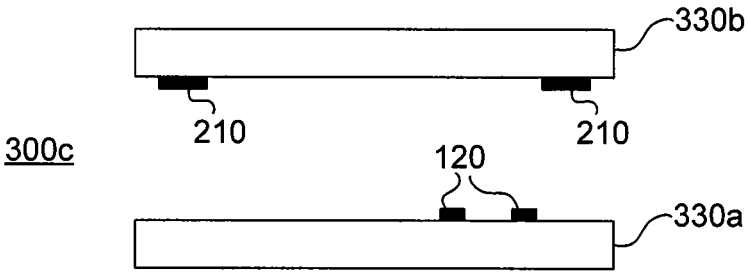

FIGS. 3A-3C are cross-sectional side views of exemplary antenna assembly substrate configurations 300 using, for example, the antenna assembly 200*a* along the cross-section 301. In antenna assembly substrate configuration 300*a*, the near-field loop antenna 120 and the dual polarized far-field antenna 210 were formed on different sides of a substrate 310, and can be inductively, capacitively, and/or ohmically coupled to one another. In antenna assembly substrate configuration 300*b*, the near-field loop antenna 120 and the dual polarized far-field antenna 210 were formed on the same side of a substrate 320, and can be inductively, capacitively and/or ohmically coupled to one another. In antenna assembly substrate configuration 300*c*, the near-field loop antenna 120 and the dual polarized far-field antenna 210 were formed, respectively, on substrates 330*a* and 330*b*. Substrates 330*a* and 330*b* can, for example, be brought together such that the near-field loop antenna 120 and the dual polarized far-field antenna 210 are inductively, capacitively, and/or ohmically coupled to one another. In one embodiment, a material, such as an insulator, can separate substrates 330*a* and 330*b*. The substrates 300*a* and 300*b* can be brought together in any configuration (i.e., the surfaces on which the antennas were formed can both point away from each other, can both point towards each other, or can both point in the same direction).

Figure 2A:
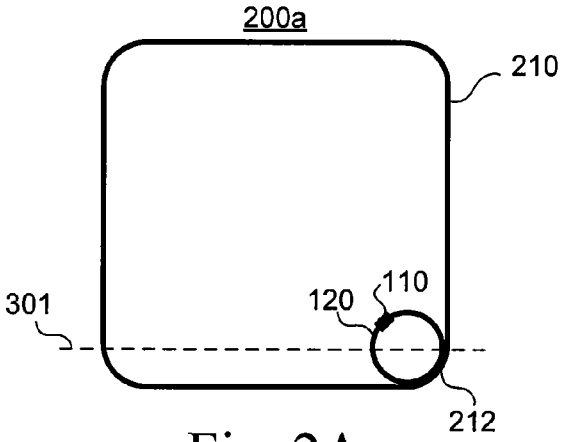
FIGS. 2A-2F are top views of different antenna assembly configurations.
Figure 2B:
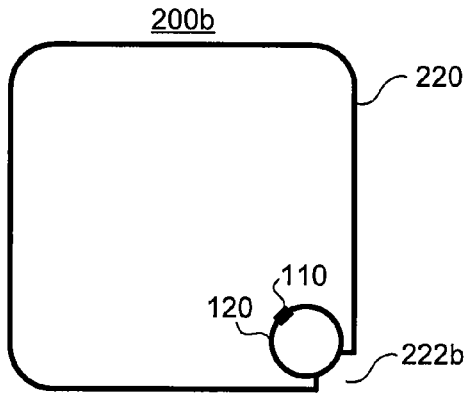
Figure 2C:
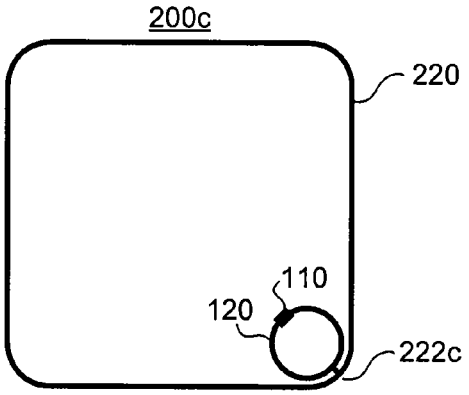
Figure 2D:
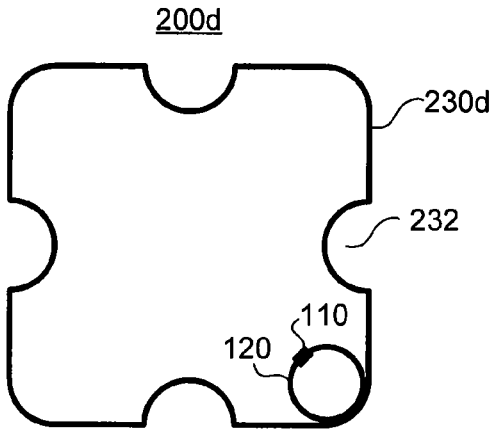
Figure 2E:
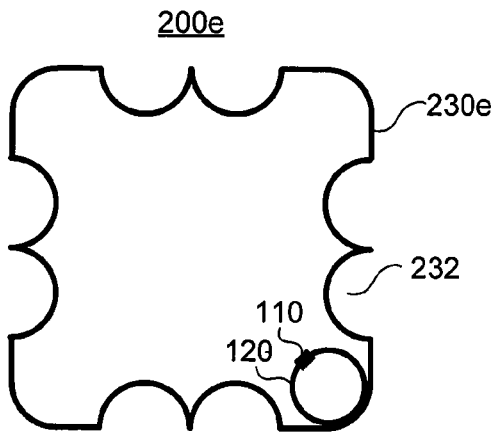
Figure 2F:
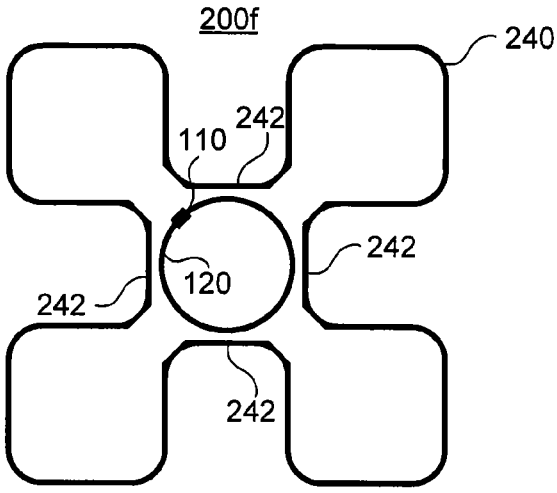
Figure 4A:
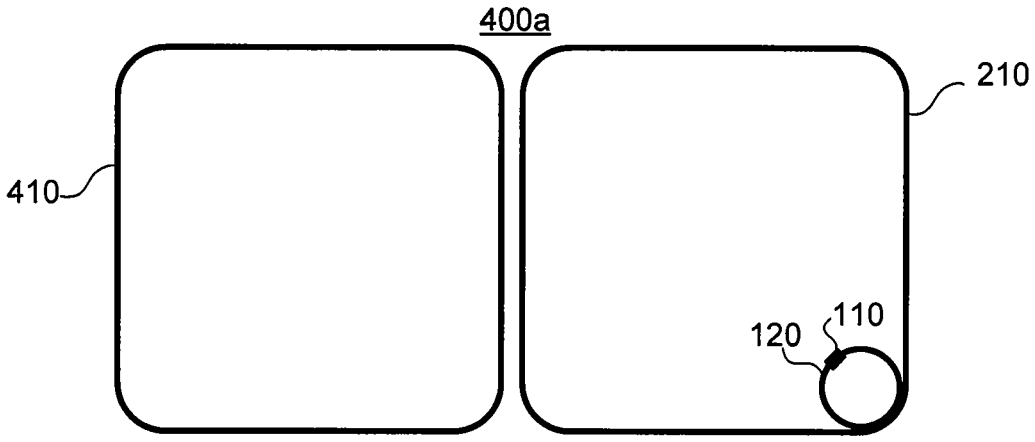
FIGS. 4A-4B is a side view of a dual far-field antenna configuration.
Figure 4B:
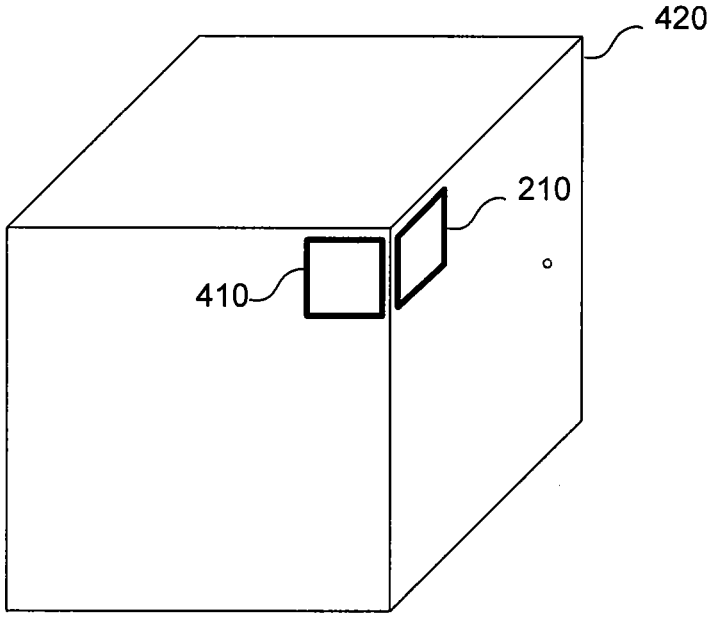

In some embodiments, a dual polarized far-field antenna can be coupled to one or more additional dual polarized far-field antennas via inductive, capacitive, and/or ohmic coupling. FIGS. 4A-B are views of a dual far-field antenna assembly 400*a*. The dual far-field antenna assembly 400*a* includes the dual polarized far-field antenna 210 and near-field loop antenna 120 as illustrated in FIG. 2A with an additional dual polarized far-field antenna 410. The dual polarized far-field antenna 410 can be inductively coupled to the dual polarized far-field antenna 210. The dual far-field antenna assembly 400*a* can be positioned on a device 420 (e.g., a cardboard box or other container) such that each far-field antenna is aligned with a different surface or direction. Providing different directional alignments of multiple far-field antennas advantageously can allow for better readability between a RFID tag and a RFID reader/writer.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed:

1. An antenna assembly comprising:

a first dual polarized far-field UHF rectangular loop antenna having semi-circle indentations located on each side, the first antenna positioned on a first substrate;

a second dual polarized far-field UHF rectangular loop antenna having semi-circle indentations located on each side, the second antenna positioned on a second substrate separate from the first substrate;

a near-field loop antenna electromagnetically coupled to the first dual polarized far-field UHF rectangular loop antenna, the near-field loop antenna comprising an antenna contact and a ground contact for electrically connecting to a chip;

wherein the second dual polarized far-field UHF rectangular loop antenna is electromagnetically coupled to the first dual polarized far-field UHF rectangular loop antenna; and wherein the near-field loop antenna is positioned in a corner of the first dual polarized far-field UHF rectangular loop antenna.

2. The antenna assembly of claim 1 wherein the chip comprises an RFID device.

3. The antenna assembly of claim 1 wherein the near-field loop antenna is inductively coupled to the first dual polarized far-field UHF rectangular loop antenna.

4. The antenna assembly of claim 1 wherein the near-field loop antenna is ohmically coupled to the first dual polarized far-field UHF rectangular loop antenna.

5. The antenna assembly of claim 1 wherein the near-field loop antenna is capacitively coupled to the first dual polarized far-field UHF rectangular loop antenna.

6. The antenna assembly of claim 1 further comprising the chip.

7. The antenna assembly of claim 1 wherein the chip is a one-channel chip.

8. The antenna assembly of claim 1 wherein the chip is a multi-channel chip comprising three or more contact pads.

9. The antenna assembly of claim 1 further comprising:

a first layer comprising metallization of the first dual polarized far-field UHF rectangular loop antenna;

a second layer comprising a carrier material; and a third layer comprising metallization of the near-field loop antenna.

10. The antenna assembly of claim 1 further comprising:

a first layer comprising a carrier material; and a second layer comprising metallization of the first dual polarized far-field UHF rectangular loop antenna and metallization of the near-field loop antenna.

11. The antenna assembly of claim 1 further comprising:

a first carrier material comprising the first dual polarized far-field UHF rectangular loop antenna; and a second carrier material comprising the near-field loop antenna.

12. A method for forming an antenna assembly, the method comprising:

forming, on a first side of a first substrate, a first dual polarized far-field UHF rectangular loop antenna having semi-circle indentations located on each side;

forming, on a second side of a second substrate, a near-field loop antenna on a second layer comprising an antenna contact and a ground contact for electrically connecting to a chip, wherein the first dual polarized far-field UHF rectangular loop antenna is electromagnetically coupled to the near-field loop antenna; and electromagnetically coupling, to the first dual polarized far-field UHF rectangular loop antenna, a second dual polarized far-field UHF rectangular loop antenna having semi-circle indentations located on each side, the second antenna formed on a third substrate separate from the first substrate and the second substrate;

wherein the near-field loop antenna is positioned in a corner of the first dual polarized far-field UHF rectangular loop antenna.

13. The method of claim 12 further comprising ohmically coupling the first dual polarized far-field UHF rectangular loop antenna to the near-field loop antenna.

14. The method of claim 12 further comprising forming segments of the first dual polarized far-field UHF rectangular loop antenna and the near-field loop antenna, wherein the segments inductively couple the first dual polarized far-field UHF rectangular loop antenna to the near-field loop antenna.

15. The method of claim 12 further comprising forming segments of the first dual polarized far-field UHF rectangular loop antenna and the near-field loop antenna, wherein the segments capacitively couple the first dual polarized far-field UHF rectangular loop antenna to the near-field loop antenna.

16. The method of claim 12, wherein the first and second substrates are different, further comprising positioning the first and second substrates together using lamination, dispensing, bonding, or any combination thereof.

17. The method of claim 12 wherein the first and second substrates are the same and the first and second sides are the same.

18. The method of claim 12 wherein the first and second substrates are the same and the first and second sides are different.

19. The method of claim 12 further comprising attaching the second substrate to a device, wherein forming the first dual polarized far-field UHF rectangular loop antenna comprises printing the first dual polarized far-field UHF rectangular loop antenna over the second substrate to be attached to the device.

20. The antenna assembly of claim 1 wherein the second dual polarized far-field UHF rectangular loop antenna is inductively coupled to the first dual polarized far-field UHF rectangular loop antenna.

21. The antenna assembly of claim 1 wherein the antenna assembly is positioned on a device such that the first dual polarized far-field UHF rectangular loop antenna is aligned with a different surface of the device than the second dual polarized far-field UHF rectangular loop antenna.

22. The antenna assembly of claim 1 wherein the antenna assembly is positioned on a device such that the first dual polarized far-field UHF rectangular loop antenna is aligned in a different direction than the second dual polarized far-field UHF rectangular loop antenna.

23. The method of claim 12 wherein the second dual polarized far-field UHF rectangular loop antenna is inductively coupled to the first dual polarized far-field UHF rectangular loop antenna.

24. The method of claim 12 wherein the third substrate is different than the first substrate and the second substrate.

25. The antenna assembly of claim 1 wherein the antenna assembly is positioned on a device such that the first dual polarized far-field UHF rectangular loop antenna is aligned with a different surface of the device than the second dual polarized far-field UHF rectangular loop antenna.

26. The method of claim 12 further comprising positioning the antenna assembly on a device such that the first dual polarized far-field UHF rectangular loop antenna is aligned in a different direction than the second dual polarized far-field UHF rectangular loop antenna.

* * * * *